US005918576A

United States Patent [19]

Ohoka et al.

[11] Patent Number: 5,918,576

[45] Date of Patent: Jul. 6, 1999

[54] AIR CLEANER FOR A MOTORCYCLE

[75] Inventors: Hisahiro Ohoka; Masato Suzuki, both of Iwata, Japan

[73] Assignee: Yamaha Hatsudoki Kabushiki Kaisha, Iwata, Japan

[21] Appl. No.: 08/725,419

[22] Filed: Oct. 3, 1996

[30] Foreign Application Priority Data

Oct. 5, 1995 [JP] Japan ..... 7-286662

[51] Int. Cl.[6] ..... F02B 77/00

[52] U.S. Cl. ..... 123/198 E; 55/385.3; 55/466

[58] Field of Search ..... 123/198 E; 55/385.3, 55/466, DIG. 28

[56] References Cited

U.S. PATENT DOCUMENTS

| | | | |
|---|---|---|---|
| 4,227,898 | 10/1980 | Kamekawa et al. . | |
| 4,280,582 | 7/1981 | Kouyama et al. | 55/DIG. 28 |
| 4,321,978 | 3/1982 | Tominaga et al. . | |
| 4,531,606 | 7/1985 | Watanabe . | |
| 4,790,864 | 12/1988 | Kostun | 123/198 E |
| 4,846,860 | 7/1989 | Yu | 123/198 E |
| 5,083,538 | 1/1992 | Hubbell | 123/198 E |
| 5,167,209 | 12/1992 | Dufern et al. | 123/198 E |
| 5,582,146 | 12/1996 | Linsbauer et al. | 55/DIG. 28 |
| 5,720,788 | 2/1998 | Puckett et al. | 123/198 E |

FOREIGN PATENT DOCUMENTS

| | | | |
|---|---|---|---|
| 55-156245 | 12/1980 | Japan | 55/385.3 |

*Primary Examiner*—Erick R. Solis
*Attorney, Agent, or Firm*—Knobbe, Martens, Olson & Bear LLP

[57] ABSTRACT

An air cleaner for an engine of the type utilized to power a motorcycle comprises a housing having an air inlet and air outlet, and an interior divided into first and second chambers. The outlet is connected to an air passage leading to the engine. The first chamber communicates with air outside of the housing though air inlet apertures. Air drawn into the first chamber is routed through a duct to the second chamber. The second chamber communicates with the outlet through a passage extending from the second chamber through the first chamber. An air filter element is positioned within the second chamber about the entrance to the passage extending to the air outlet. The air cleaner is mounted to the engine of the motorcycle with the air inlet facing the engine. The outlet of the air cleaner is connected to an air passage leading to the combustion chambers of the engine.

8 Claims, 5 Drawing Sheets

AIR CLEANER FOR A MOTORCYCLE

FIELD OF THE INVENTION

The present invention relates to an air cleaner for use with an engine of the type powering a motorcycle.

BACKGROUND OF THE INVENTION

Engines utilized to power motorcycles include an air inlet for supplying an air charge to the combustion chamber of each cylinder of the engine. Particulate matter in the air, such as dirt and sand, and other air-born matter such as bugs and grass can damage the engine if drawn through the air inlet into the combustion cylinder.

Engines utilized to power motorcycles are susceptible to drawing in dirty air. For example, in automobiles, the air intake is typically positioned well above the ground and shielded in an engine compartment. The engine of a motorcycle is typically not well shielded, and is positioned directly behind the front wheel. The front wheel propels dirt, sand and other matter into the air directly in front of the engine.

Most engines include air cleaners for screening the air before it enters the engine. These air cleaners normally comprise a filter clement positioned within the engine's air intake passage. The filter element is frequently positioned in a passage having an inlet opening facing in the direction of vehicle travel.

Air cleaners utilized in air intakes in this arrangement suffer from several drawbacks. First, the filter element is normally arranged such that the incoming air is directed at a small portion of the air filter element. This small portion of the filter element becomes contaminated more quickly than the remainder of the filter, shortening the longevity of the filter.

Also, the alignment of the air intake for the filter in the direction of the vehicle travel causes engine performance variations. At low speeds air is drawn through the intake by the engine. At higher speeds, movement of the vehicle causes a greater volume of air to pass into the intake, changing the performance characteristics of the engine as compared to the same engine operational parameters when the engine is stationary. At low speeds the air drawn into the air intake is also warmed by the engine. At higher speeds, however, much cooler atmospheric air is drawn into the air cleaner, affecting engine performance by changing the operational parameters of the engine.

A third problem with air cleaners of the type currently utilized is that they do not remove air-borne water. Water in the air charge supplied to the engine generally decreases the engine performance.

An air cleaner which includes an efficient water and solids particulate filtering mechanism and which is arranged with an air intake to prevent air flow variations to the engine is desired.

SUMMARY OF THE INVENTION

The present invention is an air cleaner and intake arrangement solving the above-stated problems. The air cleaner includes an inlet which does not face in the direction of vehicle travel and which is generally shielded from direct air flow variations. The air cleaner includes a first section for removing air-borne water, and a second section having a filter for removing particulate matter. Air circulates around the filter, distributing the filtering load across the entire filter.

More specifically, the air cleaner comprises a housing having an inlet and outlet. The housing has an interior space which is divided into first and second chambers.

The inlet comprises a pair of apertures positioned in a rear wall of the housing. These apertures permit communication of the first chamber with the atmosphere outside of the housing.

The second chamber is in communication with the outlet of the air cleaner and the first chamber. A duct having its first end positioned in the first chamber extends to a second open end leading to the second chamber. A passage extends from the second chamber to the air cleaner outlet. An air filter element is positioned in the second chamber about the entrance to the passage leading to the air cleaner outlet.

An air intake passage leads from the outlet of the air cleaner to an air box or housing. The combustion chamber of each cylinder of the engine draws air from this housing through one or more intake valves.

The air cleaner is preferably mounted on the side of an engine used to power a motorcycle. The cleaner is oriented so that the intake air apertures face the engine and away from the direction of motorcycle travel.

In use, the engine draws air through the air inlet apertures into the first chamber. In the first chamber, water is removed from the air. Removed water condenses on the walls of the first chamber and flows out of the housing through a drain.

The air continues to flow through the first chamber, the duct, and into the second chamber. Air entering the second chamber swirls throughout the chamber about the air filter element. The air passes through the filter wall and into the passage leading from the second chamber to the air cleaner outlet. The filter air them passes into the air delivery passage to an air delivery housing which is in communication with the combustion chambers of the cylinders of the engine.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
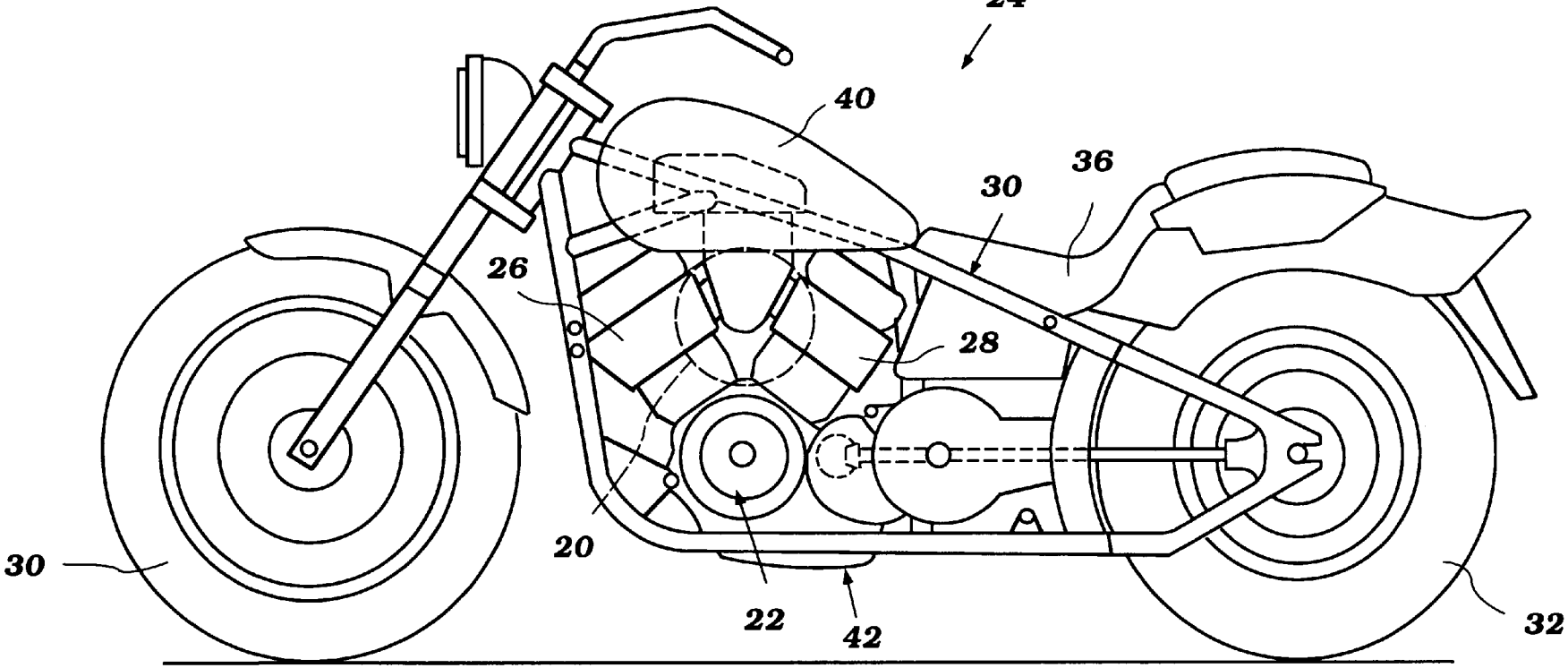
FIG. 1 is side view of a motorcycle having an engine with an air cleaner in accordance with the present invention mounted thereon.

FIGS. 1–4 illustrate an air cleaner 20 in accordance with the present invention. As illustrated in FIG. 1, the air cleaner 20 has particular utility when used with an engine 22 which powers a motorcycle 24, although those skilled in the art will appreciate the air cleaner 20 could be used on an engine utilized in any number of applications.

Figure 2:
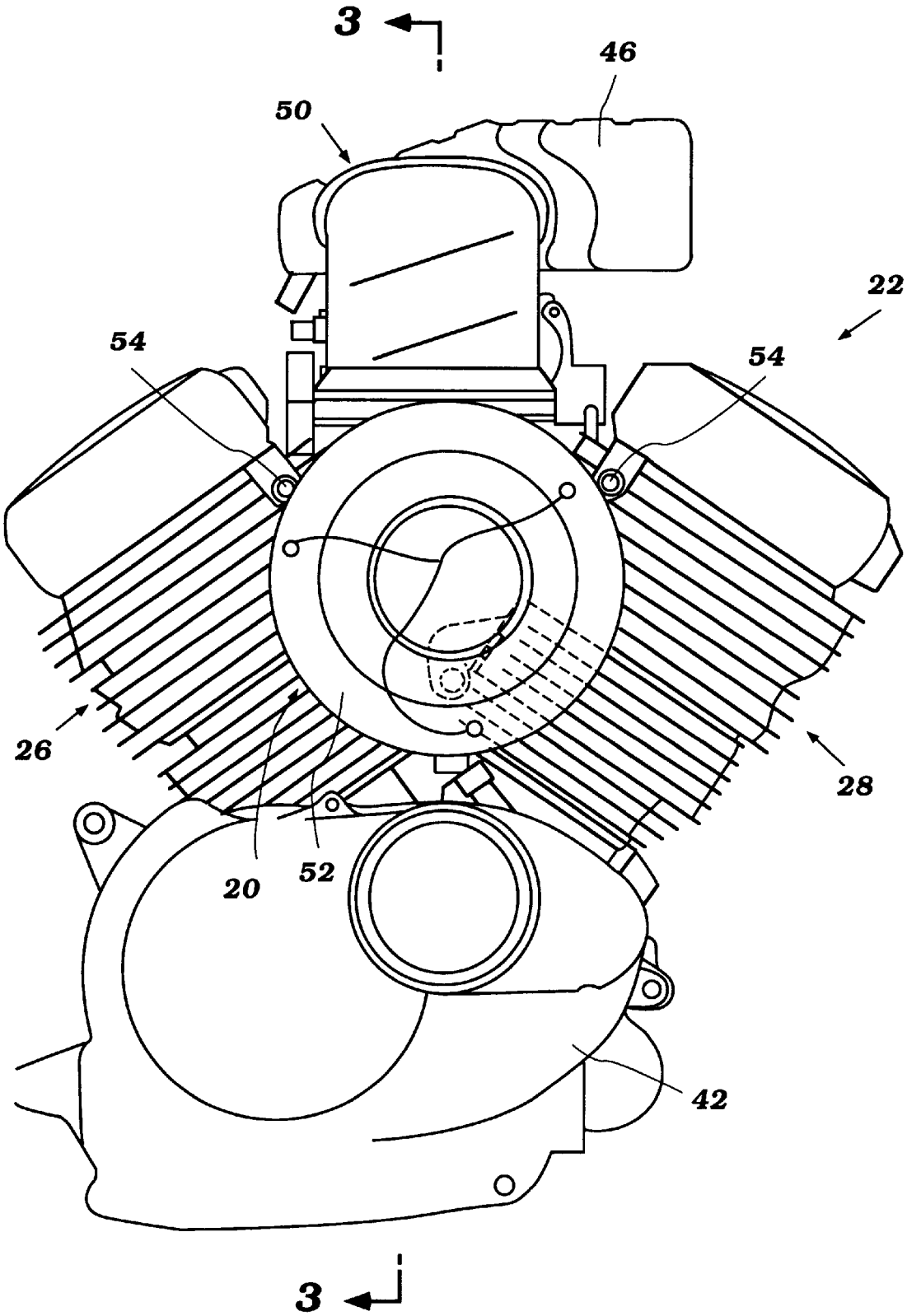
FIG. 2 is a side view of the engine of the motorcycle of FIG. 1.

As best illustrated in FIG. 2, the engine 22 is preferably of the two-cylinder, four-cycle variety. The air cleaner 20 may be utilized with any number of different types of engines, including rotary, two-cycle and single or multiple piston engines.

Referring now primarily to FIG. 2, the engine 22 is a "V"-twin type engine, having two banks of cylinders 26,28

(each containing one cylinder) mounted in a "V" configuration. Although this particular cylinder configuration is illustrated, it will be apparent to those skilled in the art how the invention may be employed with engines having other numbers of cylinders and other cylinder orientations.

As illustrated in FIGS. 1 and 2, the engine 22 is mounted to a frame 30 of the motorcycle 24. The details of a motorcycle 24 such as that illustrated are well known to those skilled in the art and will not be described in detail here. In general, however, a front wheel 32 and a rear wheel 34 are connected to the frame 30 of the motorcycle 24. A rider seat 36 is connected to the frame 30. Handlebars 38 are connected to the front or first wheel 32 for steering the motorcycle.

The engine 22 is mounted for driving the rear wheel 34 of the motorcycle 24. A fuel tank 40 is mounted to the frame 30, the tank 40 containing fuel for supplying to the engine 22. Fuel is supplied to the combustion chamber of each cylinder 26,28 from the fuel tank 40 through a fuel delivery system.

The engine 22 includes a crankcase 42. Each cylinder of the cylinder banks 26,28 includes a piston (not shown) mounted for reciprocation. The pistons are connected by connecting rods (not shown) for driving a crankshaft (not shown), the output of which is connected to the rear wheel 34.

Figure 4:
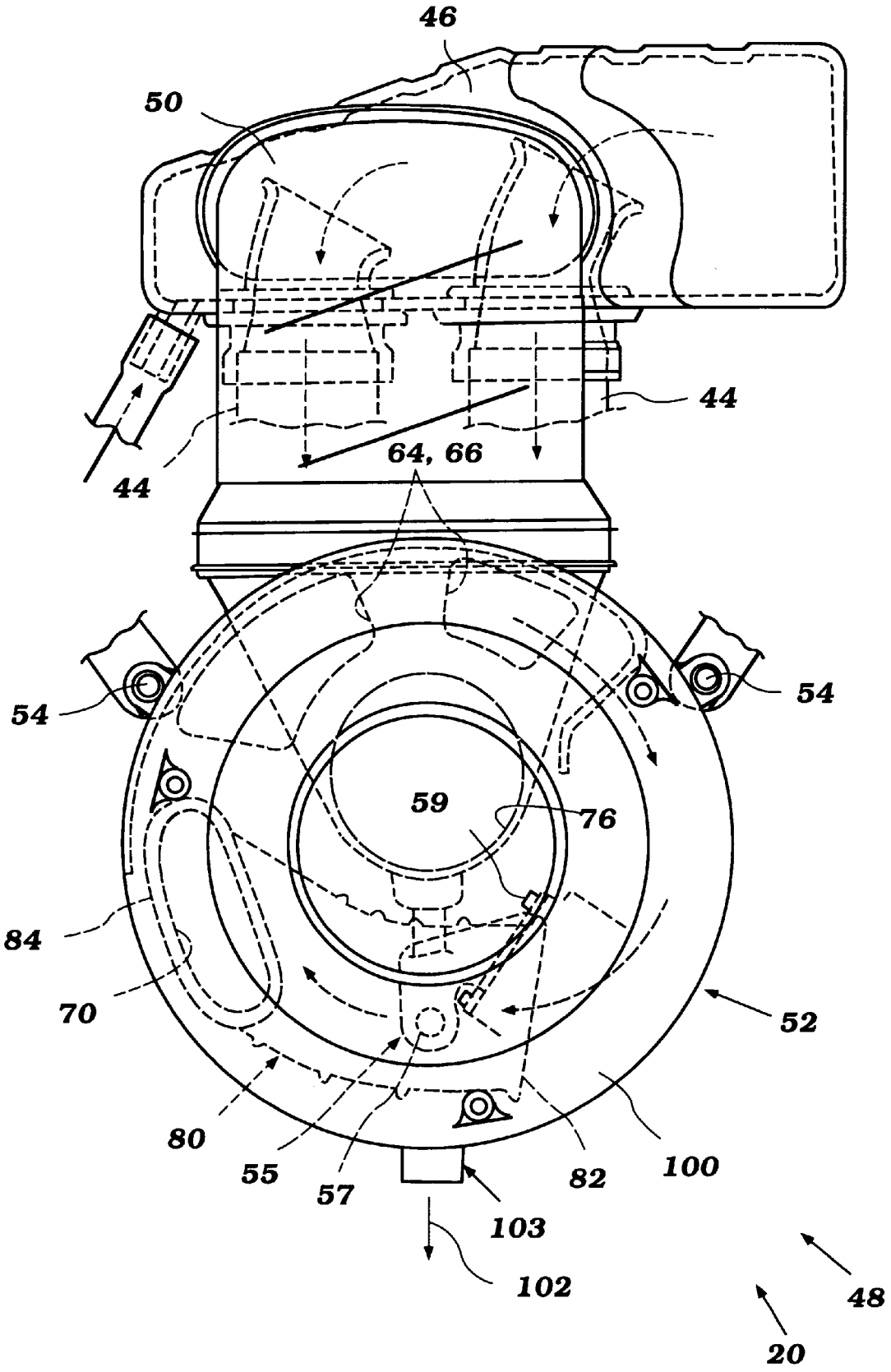
FIG. 4 is an enlarged view of the air cleaner illustrated in FIG. 2, with related apparatus therebehind illustrated in phantom lines.
Figure 5:
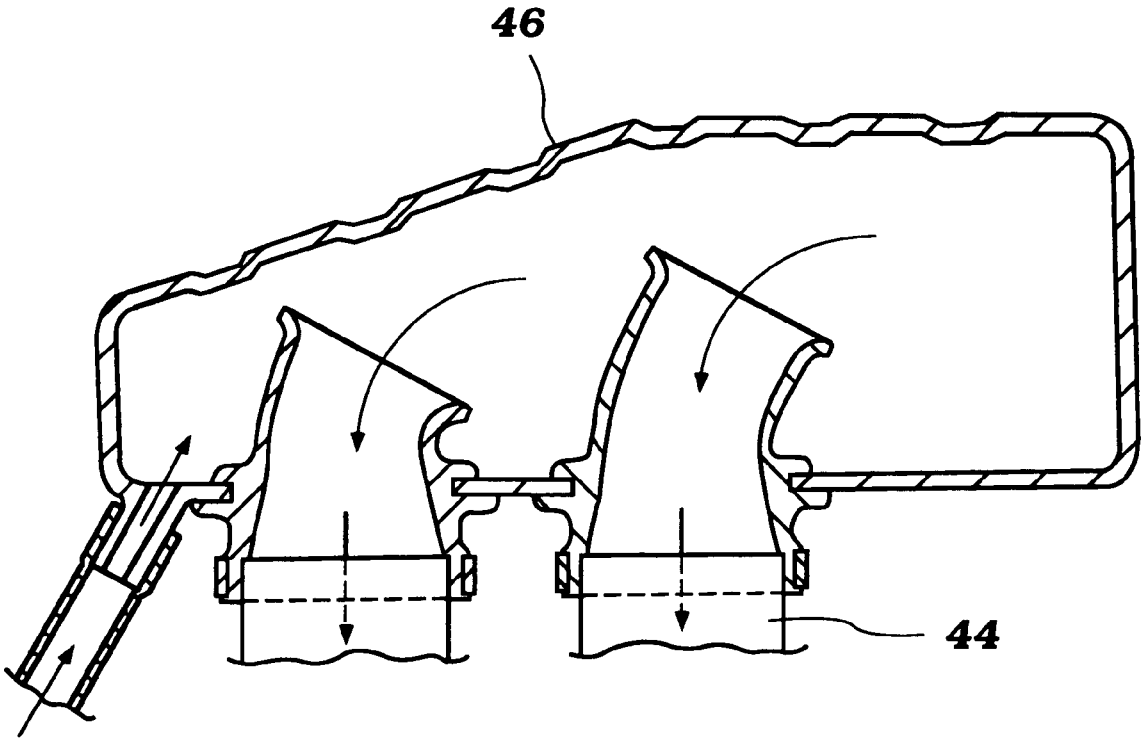
FIG. 5 is a cross-sectional view of an air intake for the air cleaner of the present invention.

Air for fuel combustion is delivered to each cylinder through an air intake passage 44, as best illustrated in FIG. 4. Preferably, a separate passage 44 corresponds to each intake valve of the cylinder, with the passages terminating in a common air delivery housing 46.

Figure 3:
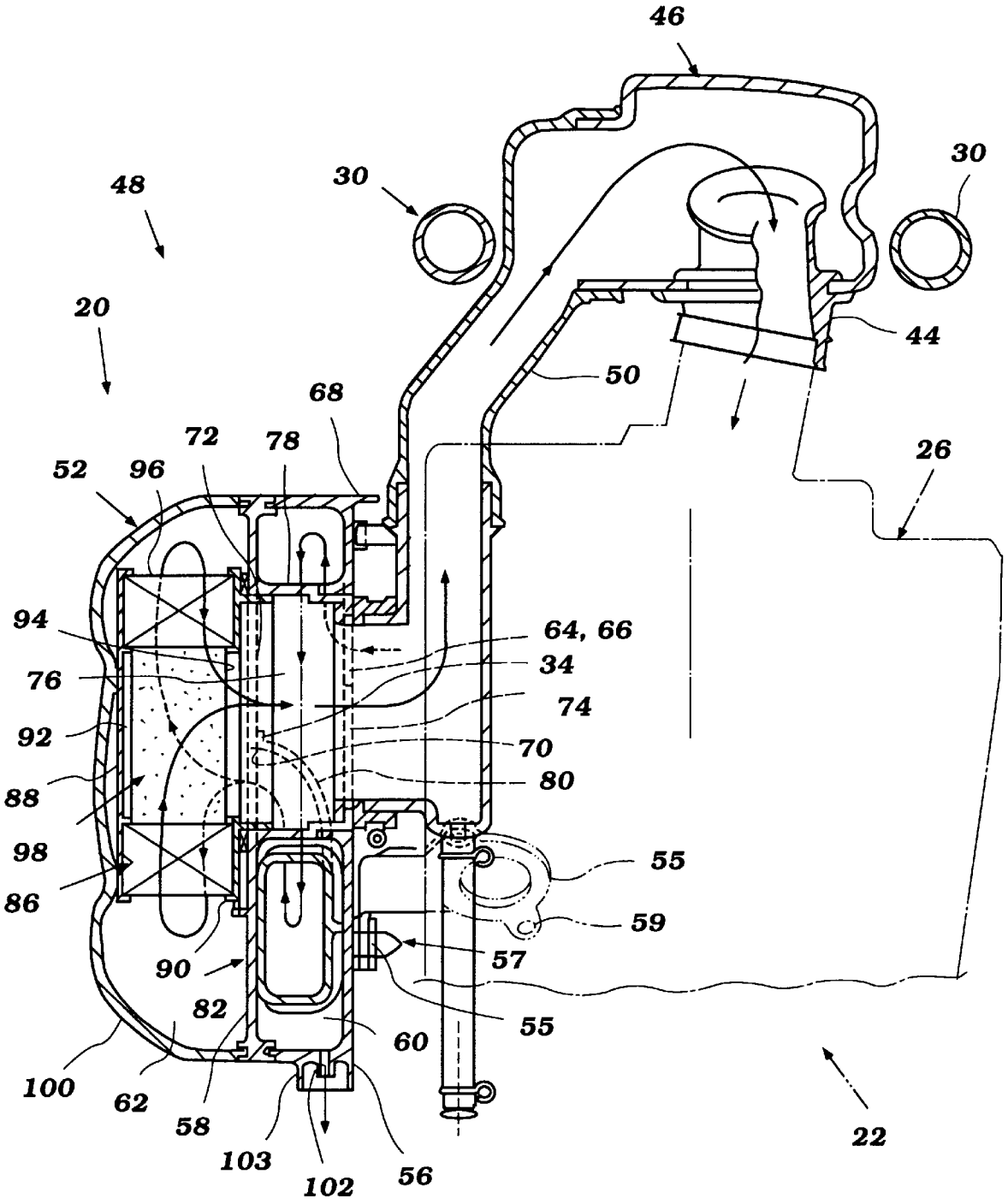
FIG. 3 is a cross-sectional view of the air cleaner of FIG. 2, taken along line 3—3 thereof.

Air is delivered to the air delivery housing 46 through an air intake system, labelled 48 in FIG. 3. This system includes an air intake in communication with air surrounding the engine, as well as the air cleaner 20 and a delivery passage 50.

As illustrated in FIGS. 2, 3 and 4, the air cleaner 20 of the present invention preferably includes a generally cylindrical shaped housing 52. The housing 52 is mounted at a top portion thereof to the side of the engine 22 with several bolts 54. The bolts 54 extend through brackets on the housing 52 and into the wall of the cylinders 26,28. In addition, a clamp 55 supports the bottom of the cleaner 20. The clamp 55 is connected to a prong 57 extending from the housing 52. The clamp 55 extends to a timing chain cover of the engine 22, and is connected thereto with bolts 59. As best illustrated in FIG. 3, the housing 52 is mounted in spaced relationship from the remainder of the engine 22, for reasons which will become apparent later.

The housing 52 includes a rear wall 56 (facing the engine 22 when mounted) and defines therein an interior space. A divider 58 is positioned within the interior space of the housing 52 and defines a first chamber 60 (closest the engine) and a second chamber 62 (farthest from the engine).

As best illustrated in FIG. 4, two air intake apertures 64,66 are positioned in the rear wall 56. These apertures 64,66 are preferably positioned near the top of the housing 52. These apertures 64,66 cause the first chamber 60 to be in communication with the atmosphere outside of the housing 52.

As will be described in more detail below, air passes from the area surrounding the engine 22 through the apertures 64,66 into the first chamber 60 and on to the engine 22. In order to reduce the occurrence of water or other matter being drawn into the cleaner 20 through these apertures 64,66, the housing 52 includes a flange 68 which extends inwardly towards the engine 22 beyond the rear wall 56. When the air cleaner 20 is mounted to the engine 22, the flange 68 is preferably adjacent the engine.

An aperture 70 is also positioned in the divider 58 for permitting communication of the first and second chambers 60,62. This aperture 70 is generally positioned to one side of a centerline passing through the housing 52 perpendicular to the engine 22 (i.e. parallel to a width of the motorcycle 24).

Yet another aperture 72 is positioned nearly centrally in the divider 58, along the centerline of the housing 52. This aperture 72 is circular in shape. A similiar shaped outlet aperture 74 is positioned in the rear wall 56 of the housing 52. These apertures 72,74 define the ends of a generally cylindrical passage 76 extending from the second chamber 62 to the outside of the housing 52 through the first chamber 60. This passage 76 is further defined by a tubular member 78 extending through the first chamber 60 and connected to the rear wall 56 and divider 58. A first end of the member 78 is in communication with the aperture 72 in the divider 58, and the second end of the member 78 is in communication with the aperture 74 in the rear wall 56. The extension of the member 78 through the first chamber 60 causes the chamber to comprise a generally arcuate passage having an overall donut or annular shape.

Preferably, a duct 80 is positioned within the first chamber 60. The duct 80 has a first open end 82 positioned in, and thus in communication with, the first chamber 60. The duct 80 extends through the first chamber 60 to a second end 84 which is in communication with the aperture 70 in the divider 58. The first end 82 of the duct 80 is preferably positioned some distance from the intake apertures 64,66 in the rear wall 56.

An air filter element 86 is positioned within the second chamber 62. A first mounting plate 88 is connected to the inside of the housing 52. A second mounting plate 90 is connected to the divider 58. The filter element 86 has a first end 92 which engages the first mounting plate 88 and a second end 94 which engages the second mounting plate 90.

The filter element 86 is preferably of the type well known in the art, comprising cloth, paper or a similar filtering material. The filter element 86 is annular in shape, comprising a circular wall 96 defining a interior passage 98.

As illustrated, the first mounting plate 88 prevents air flow through the first end 92 of the filter element 86. The second mounting plate 90 prevents air flow between the wall 96 of the filter and the divider 58 to the aperture 72. Therefore, all air passing through the second chamber 62 to the outlet 74 must pass through the filter wall 98.

In order that the filter element 86 be removable from the cleaner 20 for replacement, the housing 52 preferably includes a cap section 100. The cap section 100 is selectively connected to the remainder of the housing 52 at the divider 58 by means well known in the art, such as, but not limited to, one or more bolts or screws, clamps, inter engaging threads or the like.

The air delivery passage 50 comprises a tubular member having its first end in communication with the rear wall 56 of the housing 52 at the outlet aperture 74, and a second end in communication with the air delivery housing 46.

A drain passage 102 extends through the housing 52 connecting the first chamber 60 with the outside of the housing 52. Preferably, this drain 102 is a small bore extending through the wall defining the housing 52 at the bottom or lowermost point of the chamber 60. A flange 103 extends downwardly around the drain 102, protecting it from damage and clogging.

Air flow to the engine 22 through the air cleaner 20 of the present invention is as follows.

Outside air is drawn by the engine 22 through the inlet air apertures 64,66 from the area adjacent the engine 22 into the first chamber 60. This air circulates about the first chamber 60 to the duct 80. The air is then drawn through the duct 80 and the aperture 72 in the divider 58 into the second chamber 62. Air in the second chamber 62 swirls about the generally circular chamber before passing through the filter wall 96 of the filter element 86. The air is then drawn through the passage 76 from the second chamber 62 to the cleaner outlet 74. From there, the now filtered air is drawn up the air delivery passage 50 into the delivery housing 46, before being drawn into one of the combustion chambers of the two cylinders 26,28 of the engine 22.

The air cleaner 20 and its mounting arrangement solve the problems associated with prior art air cleaners described above.

First, water in the air which is drawn into the first chamber 60 is generally removed from the air. As the air circulates from the inlet apertures 64,66 through the first chamber 60, water is removed. The air circulates through the chamber 60 in centrifugal fashion and encounters the walls of the chamber. This effect, in addition to an air pressure drop has the effect of condensing the water in the air onto the interior walls defining the first chamber 60. This water flows out of the cleaner 20 through the drain passage 102 in the housing 52. As illustrated, the first end or entrance 82 to the duct 80 is positioned some distance from the intake apertures 64,66 leading into the first chamber 60. This causes the air to flow some distance around the generally circular path of the first chamber 60 before entering the duct 80, thereby allowing maximum water removal.

The air cleaner 20 is also extremely effective in cleaning air passing therethrough. Air which is drawn into the second chamber 62 enters the chamber 62 at a fairly high velocity and is not directed at any one specific region of the filter. The air entering the second chamber 62 swirls through the generally circular chamber about the entire circumference of the filter element 86 before passing therethrough. Air circulation is aided, in part, by causing the air to enter the second chamber 62 generally perpendicular to the direction the air passes through the wall 96 of the filter 86.

The air cleaner 20 and its arrangement on the engine 22 provides a steady supply of air without substantial fluctuation in pressure or volume. Movement of the motorcycle 24 does not force air into the cleaner 20, thus changing performance of the engine as compared to when the motorcycle is standing still. Similarly, wind gusts and the like do not affect the intake of air through the cleaner.

The placement of the air intake adjacent the engine 22 also aids in maintaining a relatively steady intake air temperature. Even when the motorcycle 20 on which the engine 22 is mounted is moving, the air drawn into the intake is that air which is shielded from the air flow and warmed by the engine.

While it is preferred that the second chamber 62 contain the filtering element 86 and the first chamber 60 be designed for water removal, the order of filtering may be reversed.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. An air cleaner for use in cleaning air delivered to an inlet opening of an air intake passage of an internal combustion engine induction system, comprising: a housing having an inlet and an outlet communicating directly with the induction system inlet opening, a first, annular chamber surrounding said outlet, said inlet communicating with said first chamber at one side thereof for establishing a circumferential flow therethrough for centrifugally removing water from said air, and a second chamber disposed on one side of said first chamber and containing a filter element for removing particulate matter from said air, a passage circumferentially spaced from said inlet for connecting said first chamber and said second chamber for allowing air flowing circumferentially through said first chamber from said inlet to pass therethrough into said second chamber, and said filter element being positioned within said second chamber such that air entering said second chamber from said first chamber passes therethrough directly to said outlet and axially through said outlet past said first chamber to the engine induction system in a direction opposite to the flow through said inlet and substantially parallel thereto.

2. An air cleaner as set forth in accordance with claim 1, wherein said housing is generally cylindrical in configuration and includes a transversely extending divider for dividing an interior space thereof into said first and second chambers with said outlet extending axially through the center of said first chamber.

3. An air cleaner as set forth in accordance with claim 2, wherein said housing includes a rear wall adapted to be juxtaposed to the associated engine and, said inlet comprises at least one aperture in said rear wall communicating with said first chamber.

4. An air cleaner as set forth in accordance with claim 2, further including an aperture in said divider through which air passes to said outlet.

5. An air cleaner as set forth in accordance with claim 4, wherein said filter element is positioned about said aperture.

6. An air cleaner as set forth in accordance with claim 1, further including a drain passage extending from said first chamber through said housing.

7. An air cleaner as set forth in accordance with claim 3, wherein said housing includes a removable cap section on a side opposite said end wall for accessing said filter element.

8. An air cleaner as set forth in accordance with claim 7 wherein the filter element comprises an annular filter element supported upon the tranversely extending divider and encircling the outlet.

* * * * *